United States Patent [19]

Tucker

[11] 4,143,827

[45] Mar. 13, 1979

[54] ROLL HOLDER FOR MOUNTING SPLIT-CORE ROLLS OF TISSUE IN A DISPENSER

[75] Inventor: Council A. Tucker, Los Angeles, Calif.

[73] Assignee: Towlsaver, Inc., City of Industry, Calif.

[21] Appl. No.: 907,924

[22] Filed: May 22, 1978

[51] Int. Cl.[2] ..... B65H 19/04; B65H 19/12

[52] U.S. Cl. ..... 242/55.3; 312/39

[58] Field of Search ..... 312/39, 41; 242/55.3, 242/55.53

[56] References Cited

U.S. PATENT DOCUMENTS

| | | | |
|---|---|---|---|
| 3,211,504 | 10/1965 | Bump | 242/55.3 |
| 3,387,902 | 6/1968 | Perrin et al. | 312/39 |

*Primary Examiner*—Mervin Stein
*Assistant Examiner*—Alex Grosz
*Attorney, Agent, or Firm*—Mahoney, Schick & Cislo

[57] ABSTRACT

A roll holder of the type for mounting split-core rolls of tissue is positioned in a dispenser moveable from an upper dispensing position to a lower exhausted position. A latch retains the roll holder in the dispensing position until tissue exhaustion permits relative movement between the split-core parts with consequent roll holder part movement to release the latch for movement of the roll holder to the lower exhausted position. The improvement includes blocking members at roll holder opposite ends normally retained inactive permitting the foregoing latch release by presence of the split-core parts, but automatically moving to active preventing latch release upon a lack of core retention. This means that the split-core must remain for proper roll holder functioning, and also that a solid core roll cannot be used with core stripping to cause roll holder functioning, in either case avoiding core stripping from the roll holder which can result in littering.

14 Claims, 12 Drawing Figures

ROLL HOLDER FOR MOUNTING SPLIT-CORE ROLLS OF TISSUE IN A DISPENSER

BACKGROUND OF THE INVENTION

This invention relates to a roll holder of the type for mounting split-core rolls of tissue and the like in a dispenser, and more particularly, to such a roll holder and dispenser wherein the roll holder with a roll of tissue mounted thereon is retained in a tissue dispensing position until the tissue of that roll is exhausted exposing the split-core, after which, relative movement between the split-core parts as urged by the roll holder releases latch means permitting the roll holder to move to an exhausted position. According to the improvements of the present invention, a unique blocking means is provided on the roll holder which senses the presence of the roll core on and remaining on the roll holder, preferably whether a split-core or a solid-core, and upon a lack of presence of the roll core on the roll holder at the time of tissue depletion, the blocking means will prevent release of the roll holder from its dispensing position. The overall effect of the present invention is, therefore, to prevent roll core stripping from the roll holder which can present a serious problem of littering. Furthermore, the improved roll holder concept of the present invention is particularly advantageously adaptable to modern, dual tissue roll dispensers.

A very pertinent example of a modern, dual tissue roll dispenser wherein the principals of the present invention may be advantageously incorporated is shown in the prior U.S. Pat. No. 3,387,902, issued June 11, 1968. As shown and described therein, the cabinet thereof operably mounts a generally vertically moveable dual roll holder assembly particularly adapted for mounting two rolls of tissue to be dispensed, initially one at a lower accessible dispensing position and one spaced thereabove at a relatively inaccessible temporary non-dispensing or storage position. With the tissue rolls of the split-core type, the lower roll in the dispensing position will dispense the tissue until depleted, thereby uncovering and releasing the particular split core. Upon release of the particular split core, relative movement between the core parts permits automatic relative movement between its roll holder parts automatically releasing latch means to move generally vertically downwardly, the core parts at all times still being retained on their roll holder. In this newly assumed position of roll holder assembly, the lower, previously dispensed roll assumes a still lower depleted or exhausted position and the upper, previously stored roll assumes a dispensing position from which tissue may now be dispensed just as before.

To even further increase the convenience in using this prior dual tissue roll dispenser, the dual roll holder assembly and its cabinet mounting thereof is particularly constructed to permit the dual roll holder assembly to be inserted into its cabinet with either roll holder of the assembly as the initially dispensing roll holder with the other as the upper roll holder. In other words, the dual roll holder assembly is selectively reversable and this choice is solely at the selection of the maintenance personnel required to periodically replenish the depleted tissue rolls. This reversibility of the roll holder, in most situations, reduces maintenance effort as well as reduces tissue roll waste, in that, the usual time that the roll replenishment operation will take place is when the initially lower roll had been depleted, the dual roll holder has moved downwardly placing this lower roll in a still lower depleted position, and the initially upper roll has been moved downwardly to its dispensing position with partial dispensing therefrom having taken place. If the dual roll holder were not selectively reversable, the roll replenishment operation would require that the split-core be removed from the lower roll holder, the partially dispensed roll on the upper roll holder removed and mounted on the lower roll holder, and a fresh tissue roll placed on the upper roll holder, since if fresh tissue rolls are placed on each roll holder, the partially dispensed roll would be wasted. However, with the selective reversibility of the roll holder assembly, it is only necessary to reverse the roll holder positioning, place a fresh tissue roll on the previously lower, but now upper roll holder and insert the dual roll holder in this reverse position to properly place the partially dispensed roll as the lower roll in dispensing position.

Although this prior dual roll holder dispenser has received quite wide and ready acceptance due to its uniqueness and versatility, a problem has been encountered therewith as a result of human error. Attempts have been made to use solid core tissue rolls, that is, rolls having a hollow cylindrical core extending without means for separation the entire axial extent of the roll, or split-core rolls separable at improper locations. In either case, when such rolls are attempted to be used with the dispenser, after the initially lower roll has been exhausted exposing the core thereof, the dual roll holder cannot be automatically released for placing the originally upper roll in its lower dispensing position since the releasing latch means will not function without the precisely determined proper split core separation. Thus, the only way that it has been possible to cause such functioning has been to strip the improper and now uncovered core from the lower roll holder with the result that the stripped cores have created unwanted and objectionable littering, clearly deleterious to our environment.

OBJECTS AND SUMMARY OF THE INVENTION

It is, therefore, an object of this invention to provide a roll holder of the type for mounting split-core rolls of tissue in a dispenser making use of the roll split core for predicated roll holder movement when the roll of tissue is depleted wherein unique blocking means is provided on the roll holder making the release means thereof nonfunctional when rolls of tissue with improper cores are attempted to be used thereon. In a preferred embodiment and according to the present invention, the blocking means may comprise a blocking member for each of the usually two core parts, that is, preferably one at either end of the roll holder and where the precisely determined two core parts are relatively moveable to, in turn, permit movement of at least one axial part of the roll holder relative to another for releasing the described latch means. Thus, if it is attempted to strip a solid roll core or improper split cores at either roll holder end, the appropriate blocking member will be immediately actionable to prevent release of the roll holder by blocking operation of the roll holder latch means. Core stripping is thereby prevented and the ecology damaging littering problem is eliminated.

It is a further object of this invention to provide a roll holder of the foregoing type and having the referred to unique blocking means incorporated therein efficiently solving the ecology damaging problems of the prior constructions which may be specifically adapted for use in a dual roll holder assembly of a prior dual tissue roll dispenser, and particularly where the dual roll holder assembly is conveniently selectively reversible as hereinbefore discussed. According to a further part of the present invention, the discussed unique blocking means may be incorporated in substantially the same form in each of the roll holders in the dual roll holder assembly, each actionable in substantially the same manner blocking the particular roll holder latch release in the event of the ecology damaging core stripping taking place. Thus, regardless of which of the end for end positioning the dual roll holder assembly may assume, the unique safeguards are provided, all in a manner to be hereinafter described in detail.

Other objects and advantages of the invention will be apparent from the following specification and the accompanying drawings which are for the purpose of illustration only.

DESCRIPTION OF THE BEST EMBODIMENTS CONTEMPLATED

Figure 1:
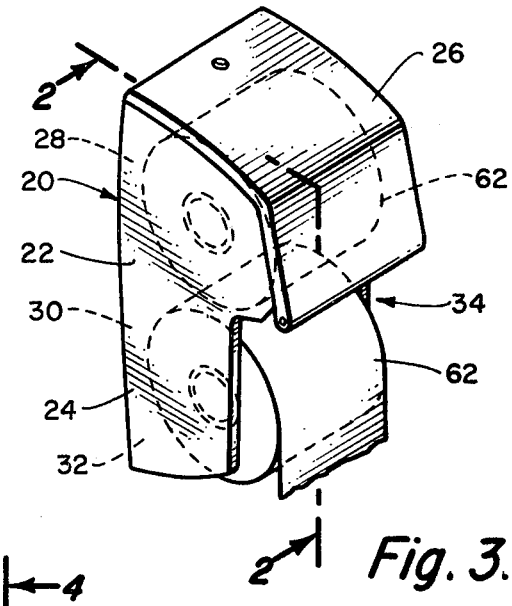
FIG. 1 is a perspective view of a dual tissue roll dispenser incorporating a first preferred embodiment of the roll holder improvements of the present invention, the dual roll holder assembly of the dispenser being shown in its initial position with the lower roll holder retaining a tissue roll in a dispensing position and the upper roll holder retaining a tissue roll in a storage position.
Figure 2:
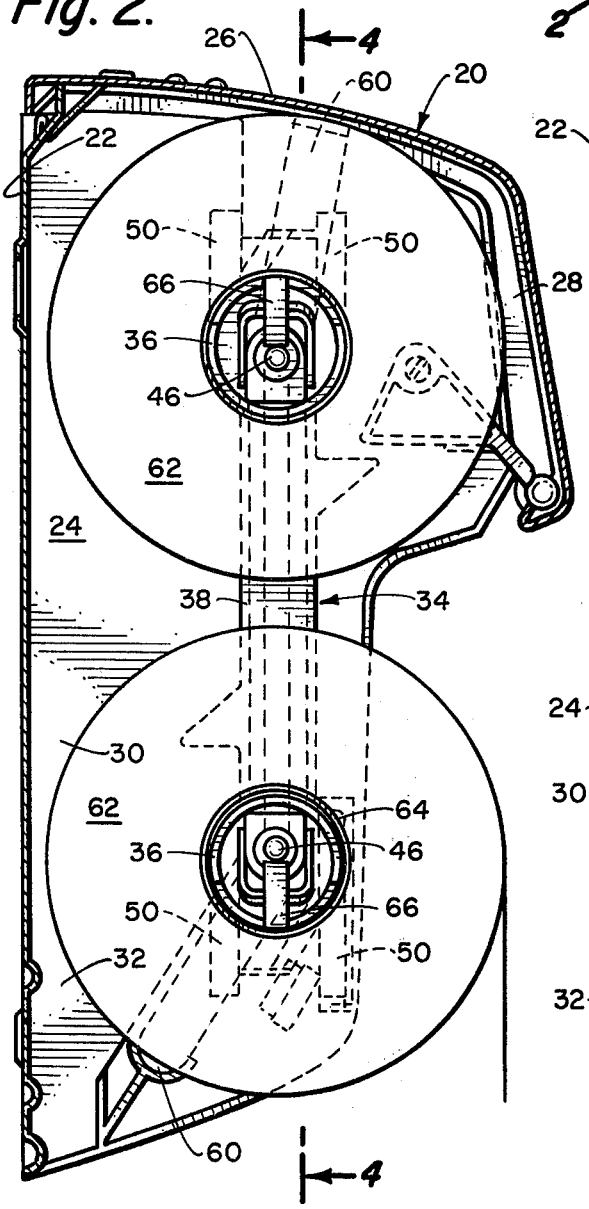
FIG. 2, is an enlarged, vertical sectional view of the dispenser of FIG. 1 looking in the direction of the arrows 2—2 in FIG. 1 and with the dual roll holder assembly still in its initial position.
Figure 3:
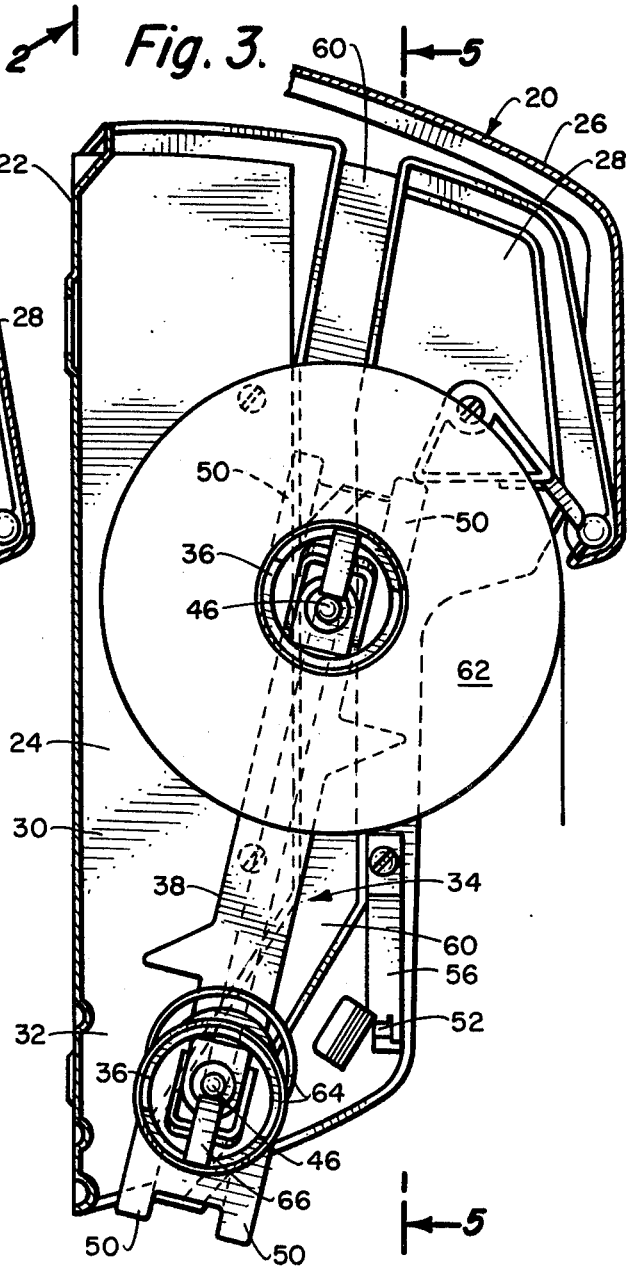
FIG. 3 is a view similar to FIG. 2, but with the tissue roll on the lower roll holder being depleted and the dual roll holder assembly having moved downwardly placing the lower roll holder in a still lower exhausted position and the upper roll holder now in a lower dispensing position.

Specific embodiments of the roll holder inventive principles of the present invention are illustrated in the drawings incorporated in a dual roll holder assembly of a well-known, prior dual roll dispenser. The prior dual roll dispenser is fully disclosed and claimed in the prior U.S. Pat. No. 3,387,902 issued June 11, 1968 and entitled "Dispenser for Sequentially Dispensing Rolls of Tissue and the Like" so that only those elements thereof necessary for a clear understanding of the roll holder principles of the present invention are shown and described herein to form the necessary background environment. It should be understood, however, that the roll holder principles of the present invention can be equally well applied to other forms and types of dispensers, and that it is not intended to limit the scope of the present invention to the particular embodiments and illustrative environment shown.

Referring initially to FIGS. 1 through 6, 9 and 10, a dual roll dispenser generally indicated at 20 includes a wall-mounted hollow cabinet 22 having parallel side walls 24 mounting a selective pivotal cover 26 normally closing the cabinet both upwardly and an upper part forwardly so as to form an upper roll storage pocket generally indicated at 28. The lower portion of the cabinet 22 opens both forwardly and downwardly to form a lower roll dispensing pocket generally indicated at 30 and an extreme lower roll exhausted pocket generally indicated at 32, the latter slightly upwardly overlapping the dispensing pocket. The normal closed position of the cover 26 is shown, for instance, in FIGS. 1 and 2 with the cover being forwardly pivotal relative to the side walls 24, the start of such pivoting being shown in FIG. 3 for opening the cabinet upwardly to permit the selective insertion or removal of a dual roll holder assembly generally indicated at 34.

Figure 6:
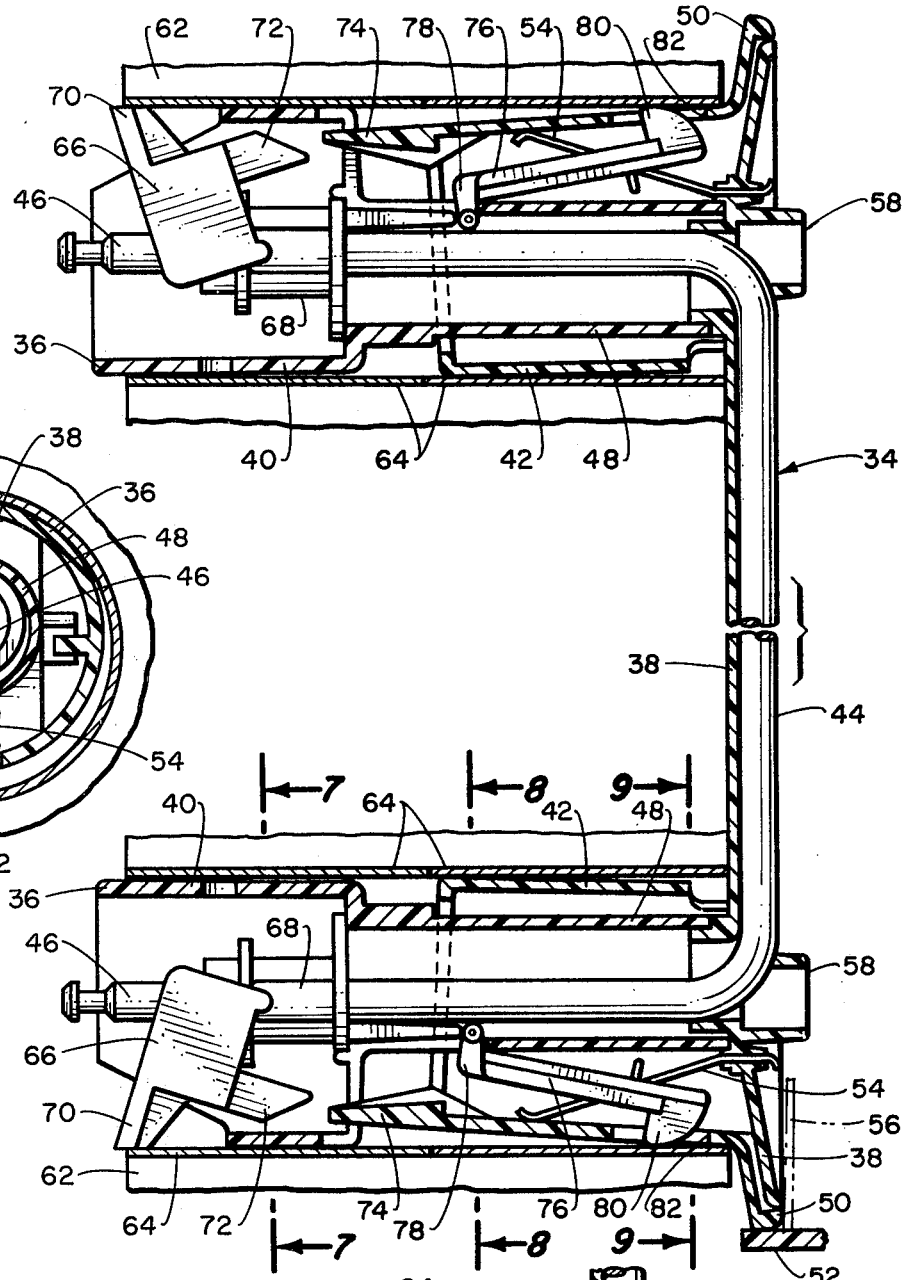
FIG. 6 is an enlarged, fragmentary, vertical sectional view of the dual roll holder assembly separate from the dispenser with the exception that the dual roll holder assembly is in the form as if it were positioned in the dispenser in its initial upper position as in FIGS. 1, 2 and 4, with a portion of the dispenser being shown retaining it in such position.

As shown, for instance, in FIG. 6, the dual roll holder assembly 34 is generally C-shaped in overall configuration including spaced, parallel roll holders 36 joined by a rigid connecting portion 38. In operative position in the cabinet 22, as will be later explained more in detail, the dual roll holder assembly 34 extends generally vertically as shown in FIG. 6, that is, with one of the roll holders 36 spaced above the other, and the two roll holders are substantially identical except oriented in opposite vertical directions. As a consequence, and again as will be hereinafter explained more in detail, the dual roll holder assembly 34 is selectively, generally vertically reversible relative to the cabinet 22, that is, the assembly may be inserted into the cabinet with either of the roll holders 36 as the lower roll holder and the other as the upper roll holder.

Figure 9:
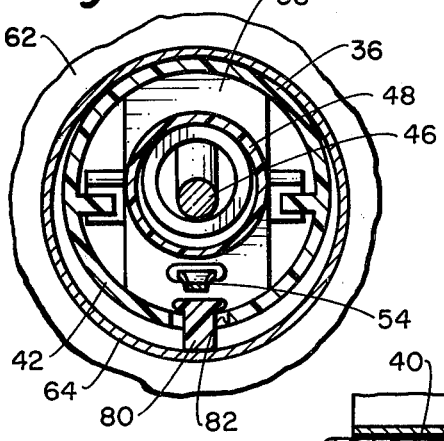
FIG. 9 is a vertical sectional view looking in the direction of the arrows 9—9 in FIG. 6.

In the assembly of the individual roll holders 36, each is generally cylindrical and includes a stationary holder portion 40 and a pivotal holder portion 42, the stationary holder portion being axially toward the free end thereof and the pivotal holder portion axially adjacent the connecting portion 38 of the overall dual roll holder assembly 34. Both the roll holders 36 and the connecting portion 38 are partially formed by a rigid, generally C-shaped yoke 44 and spaced leg portions 46 thereof each form mounting parts of the respective roll holders 36 as clearly shown in FIG. 6. For each of the roll holders 36, the stationary holder portion 40 telescopes the yoke leg portion 46 and includes a reduced, hollow cylindrical part 48 extending axially to the end of the connecting portion 38 where it is secured for, in turn, securing the stationary holder portion to the connecting portion 38 of the overall assembly. The pivotal holder portion 42 of each roll holder 36 telescopes and is spaced radially outwardly from an inner part of the respective reduced cylindrical part 48 on the stationary holder portion 40 and is radially pivotally connected thereto axially adjacent the connecting portion 38 as shown in FIG. 9.

Figure 10:
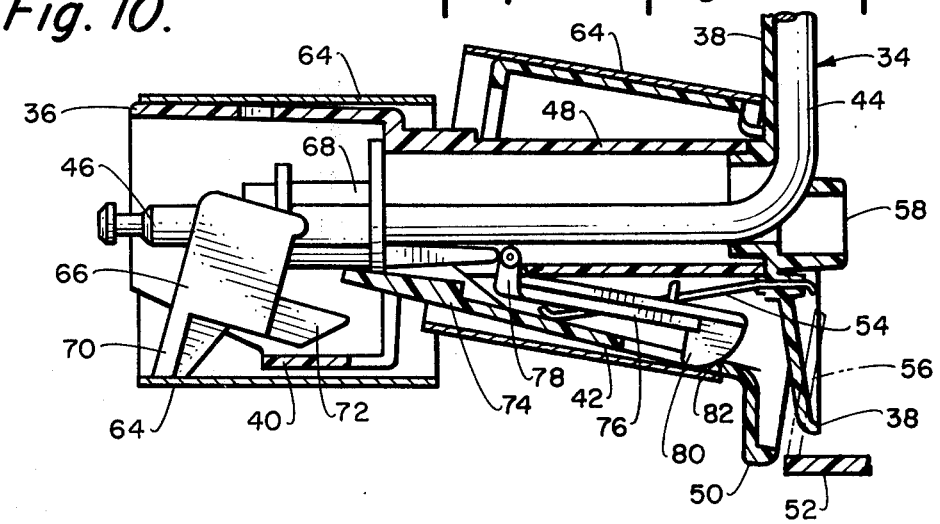
FIG. 10 is a view similar to FIG. 6, but only including essentially the lower roll holder of the dual roll holder assembly and with the lower roll holder having latch means thereof in released position releasing the dual roll holder assembly for automatic downward movement.

Thus, when either of the roll holders 36 is the lower roll holder of the dual holder assembly 34, there can be relative movement between the stationary and pivotal holder portions 40 and 42 thereof with the pivotal holder portion pivoting upwardly from general axial alignment with the stationary holder portion as shown in FIG. 6 to the upper pivotal position shown in FIG. 10. Furthermore, as shown, for instance, in side views in FIGS. 6 and 10 and in end views in FIGS. 2 and 3, each of the pivotal holder portions 42 has a pair of spaced latch engagement legs 50 secured thereto such that when the pivotal holder portion is on the lower of the roll holders 36, the latch engagement legs thereof project generally downwardly adjacent the connecting portion 38 movable directly with the pivotal holder portion. When the stationary and pivotal holder portions 40 and 42 are axially aligned in the then lower roll holder 36, the latch engagement legs 50 are positioned for downward engagement with a stationary horizontal latch 52 projecting from the cabinet side wall 24 as shown in fragmentary view in FIG. 6, and when the particular pivotal holder portion pivots upwardly relative to its associated stationary holder portion 40, the latch engagement legs move horizontally off of the latch as shown in FIG. 10.

A holder leaf spring 54 is assembled in each of the roll holders 36 directed against the pivotal holder portion 42 thereof resiliently resisting pivotal movement of that pivotal holder portion so as to urge the stationary and pivotal holder portions 40 and 42 to remain axially aligned. These holder leaf springs 54 thereby retain the stationary and pivotal holder portions 40 and 42 of each of the roll holders 36 axially aligned when the dual roll holder assembly 34 is removed from the dispenser cabinet 22 making it more convenient for mounting rolls of tissue thereon as will be hereinafter described. However, a stronger latch leaf spring 56 is mounted on the appropriate side wall 24 of the cabinet 22 as shown, for instance, in FIG. 4 effective at the latch 52 for urging the particular roll holder latch engagement legs 50 horizontally from the latch thereby tending to pivot the particular pivotal holder portion 42 when the same is free from radial restraint as will also be hereinafter described. Finally, in the dual roll holder assembly 34, the leg portions 46 of the yoke 44 project axially outwardly of the respective roll holders 36 or outwardly of the stationary holder portions 40 thereof as shown, and axially aligned projections 58 are provided at the opposite ends of the roll holders, all for being downwardly slidably received in appropriate tracks 60 of the cabinet side walls 24 to support the dual roll holder assembly 34 in the cabinet 22 while being downwardly slidable therein.

Figure 4:
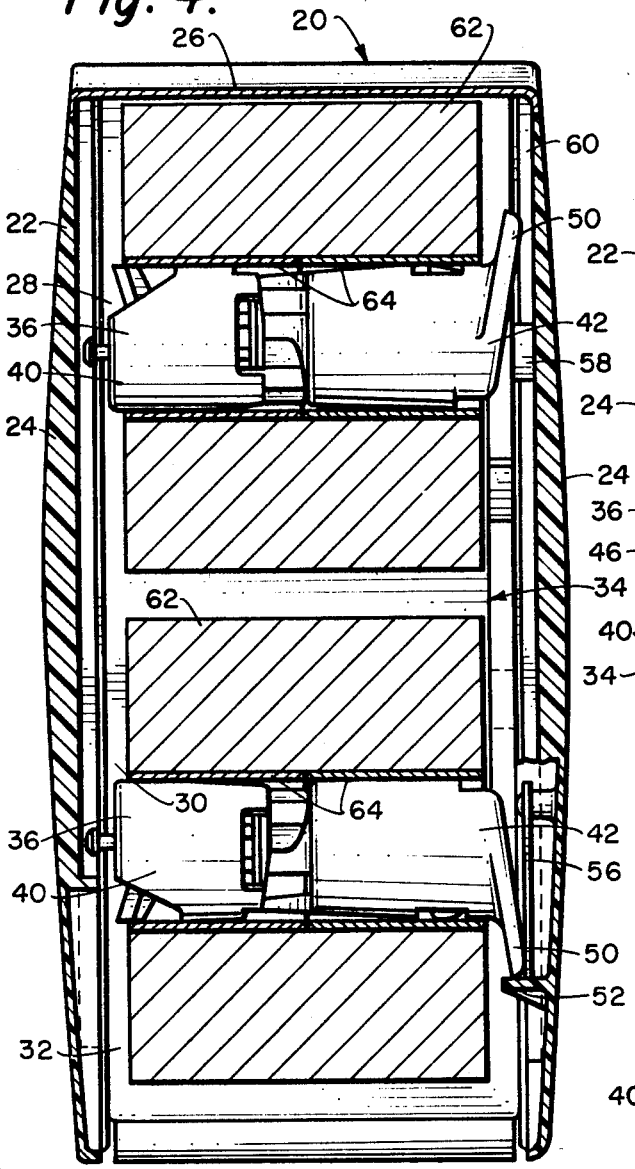
FIG. 4 is a vertical sectional view looking in the direction of the arrows 4—4 in FIG. 2.
Figure 5:
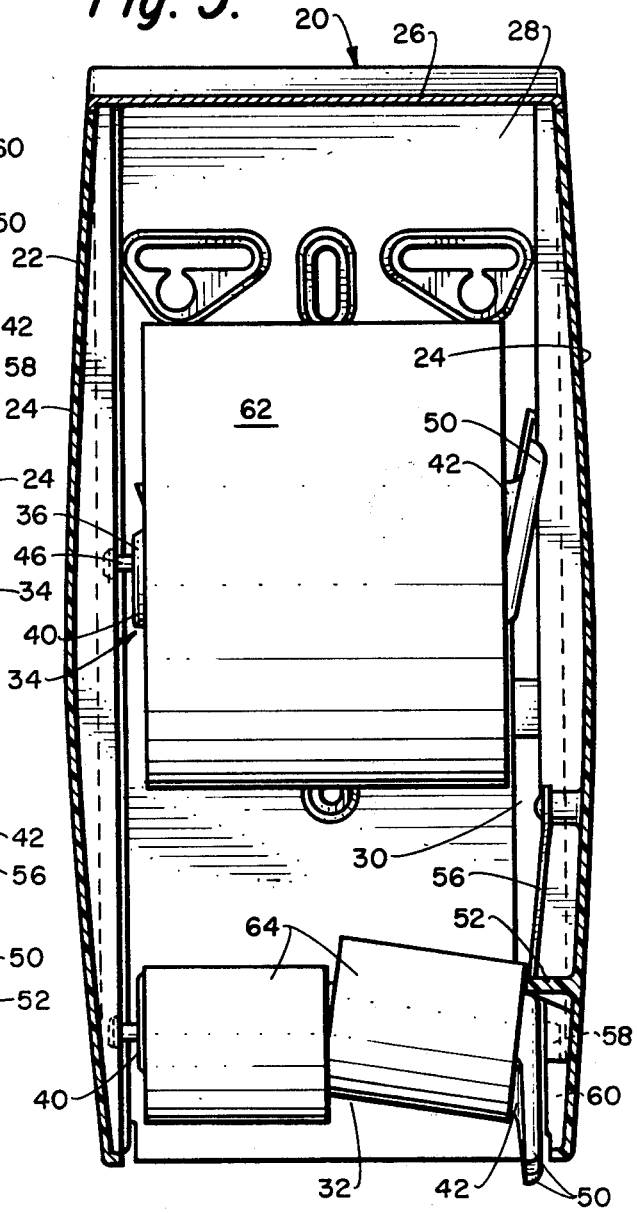
FIG. 5 is a vertical sectional view looking in the direction of the arrows 5—5 in FIG. 3.
Figure 7:
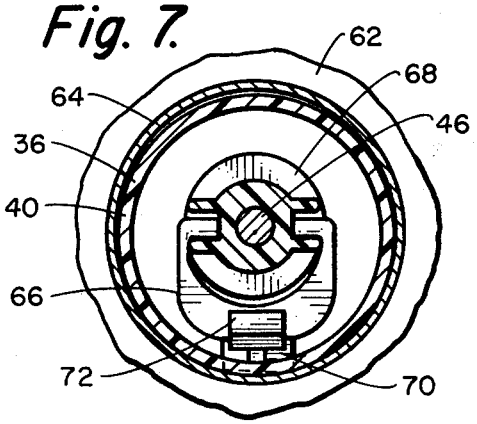
FIG. 7 is a vertical sectional view looking in the direction of the arrows 7—7 in FIG. 6.
Figure 8:
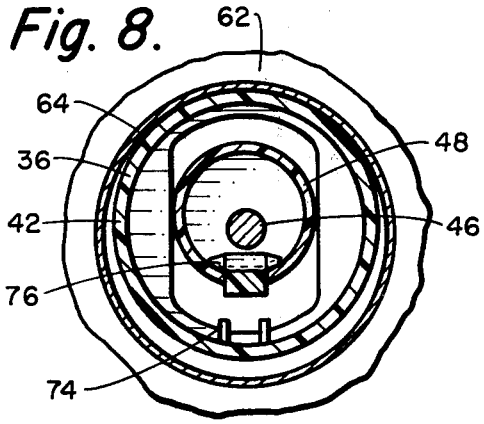
FIG. 8 is a vertical sectional view looking in the direction of the arrows 8—8 in FIG. 6.

In general use of the dispenser 20 without consideration of the roll holder improvements of the present invention, the dual roll holder assembly 34, removed from the cabinet 22, has a full roll of tissue 62 axially inserted on each of the roll holders 36 thereby telescoping each of the roll holders with a split core 64 of that particular roll of tissue. As illustrated in FIGS. 4 and 6, the split cores 64 are constructed axially or radially separable precisely at an axial location between the stationary and pivotal holder portions 40 and 42 of the roll holders so that if the tissue of that particular roll of tissue 62 is removed, the parts of the split core 64 are separable permitting the respective stationary and pivotal holder portions of that roll holder to separate. Thus, there is a part of the split core 64 of the roll of tissue 62 for and covering each of the holder portions 40 and 42 of the particular roll holder 36.

After the rolls of tissue 62 are mounted on the dual roll holder assembly 34 as described, the cover 26 of the dispenser 20 is opened by pivoting the same upwardly and forwardly and the dual roll holder assembly is inserted downwardly into the cabinet 22 received in the tracks 60 as shown in FIGS. 1, 2, 4 and 6 until the latch engagement legs 50 of the pivotal holder portion 42 on the lower of the roll holders 36 engage the latch 52 on the cabinet side wall 24. At this point, it is seen that the tissue of the rolls of tissue 62 surrounding the split cores 64 thereof retain the parts of the split core aligned thereby retaining the stationary and pivotal holder portions 40 and 42 of the roll holders 36 axially aligned. This thereby places and retains the dual roll holder assembly 34 in the position of FIGS. 1, 2, 4 and 6 with the upper of the roll holders 36 and its full roll of tissue 62 in the cabinet upper roll storage pocket 28 while the lower of the roll holders with its full roll of tissue is in the cabinet lower roll dispensing pocket 30.

Since the lower roll of tissue 62 on the lower roll holder 36 of the dual roll holder assembly 34 is in the lower roll dispensing pocket 30 of the cabinet 22 exposed forwardly and downwardly of the cabinet, the tissue on the roll is dispensed therefrom while the upper roll of tissue is retained in the upper roll storage pocket 28 essentially not freely accessible. Once all of the tissue on the lower roll of tissue 62 is depleted, thereby exposing the split core 64 thereof, the separable parts of the split core permit the pivotal holder portion 42 of the lower roll holder 36 to pivot radially upwardly relative to the stationary holder portion 40 as urged by the latch leaf spring 56 on the cabinet side wall 24 in the manner shown in FIG. 10. This moves the latch engagement legs 50 of the lower roll holder 36 transversely from engagement with the cabinet latch 52 and permits the dual roll holder assembly 34 to automatically move from the position shown in FIGS. 2 and 4 to the spaced lower position shown in FIGS. 3 and 5 placing the now depleted or exhausted lower roll holder 36, still with its split core 64, in the extreme lower roll exhausted pocket 32 and the upper roll holder with its full roll of tissue 62 in an accessible dispensing position forwardly and downwardly accessible of the cabinet 22.

Dispensing of tissue from the upper roll holder 36 of the dual roll holder assembly 34 will commence and continue until the time arrives for a usual maintenance replenishment operation, at which time, the cover 26 of the cabinet 22 will be opened, the dual roll holder assembly 34 removed upwardly by upward sliding in the cabinet tracks 60 and a full roll of tissue placed on the previously lower roll holder 36 after removal of the split core 64 therefrom. Since the roll holders 36 are substantially identical and operate in the same manner as described, the dual roll holder assembly 34 is then merely turned end for end and reinserted in the same manner into the cabinet 22. This places the previously upper roll holder 36 with its partially depleted roll of tissue 62 in the lower position and the previously lower roll holder with its full roll of tissue in the upper position so that the partially depleted roll of tissue can then be dispensed followed by the subsequent automatic movement of the dual roll holder assembly 34 in the same manner as before.

More particularly to the problems presented and solved by the improvements of the present invention, it is pointed out that if rolls of tissue 62 having solid cores or improper split cores which are not nearly precisely as the split core 64, the automatic downward movement of the dual roll holder assembly 34 in the cabinet 22 upon depletion of or exhaustion of the tissue at the then lower of the roll holders 36 cannot take place without stripping off from that roll holder the particular improper core. In other words, unless nearly the precise split core 64 is present at the lower of the roll holders 36 when the tissue has been fully dispensed and is exhausted freeing such split core, the pivotal holder portion 42 of the lower roll holder will not be free to pivot relative to the stationary holder portion 40 thereof for releasing the dual roll holder assembly 34 for its downward movement. Thus, if rolls of tissue 62 having improper cores are used, the cores will be stripped therefrom to permit the automatic actuation of the dispenser 20 in many cases with the floor surrounding the dispenser being littered by these stripped off cores. Thus, the incorporation of the present invention is required to prevent such ecology damaging littering.

According to the principles of the present invention, and referring to FIGS. 6 through 10, blocking means is preferably substantially identically installed in each of the roll holders 36 of the dual roll holder assembly 34 to prevent the automatic movement of the dual roll holder assembly when the tissue of the lower roll of tissue 62 is depleted if an improper and non-operable core is present and is stripped therefrom in an effort to cause such automatic operation. With the blocking means substantially identically in each of the roll holders 36, the dual roll holder assembly 34 will still be fully selectively reversible and either of the roll holders will be capable of guarding against the unwanted core stripping. Thus, all of the advantages of the dispenser 20 as previously described will still be fully provided.

Specifically to the first preferred embodiment illustrated, a first blocking member 66 is pivotally connected to a collar 68 secured telescoping the yoke leg portion 46 radially inwardly of each stationary holder portion 40. Each of the first blocking members 66 includes a generally radially extending sensing dog 70 and a generally axially extending blocking dog 72. The mounting of the first blocking members 66 is such that the sensing dogs 70 project generally radially downwardly when the particular roll holder 36 is the lower roll holder of the dual roll holder assembly 34, projecting oppositely upwardly in the then upper roll holder, and so as to be generally axially aligned with the latch engagement legs 50 on the pivotal holder portion 42 of that roll holder. Furthermore, the mounting of the first blocking member 66 is arranged such that when the sensing dog 70 of the particular first blocking member extends at a slight angle from radially, the blocking dog 72 thereof is free of radial interference with a generally axially extending blocking projection 74 on the particular pivotal holder portion 42 of that roll holder, but when the sensing dog 70 extends substantially radially by pivoting of the first blocking member, the blocking dog 72 will axially overlap and interfere with the pivotal holder portion blocking projection 74.

A second blocking member 76 is generally axially aligned with the first blocking member 66 radially inwardly of the pivotal holder portion 42 of the particular roll holder 36 and has a secured end 78 pivotally connected to the reduced cylindrical part 48 of the particular stationary holder portion 40 by reception in an appropriate slot thereof and abutment by a part of the collar 68 as shown. A generally axially opposite blocking end 80 of the second blocking member 76 slightly axially spaced from the connecting portion 38 at that roll holder 36 is generally radially aligned with a sensing slot 82 radially through the particular pivotal holder portion 42 as also shown. The blocking end 80 of the second blocking member 76 and the sensing slot 82 are positioned and configured such that when the second blocking member is pivoted radially inwardly with the blocking end only slightly projecting through the pivotal holder portion sensing slot 82, that particular pivotal holder portion will be pivotal relative to its associated stationary holder portion 40 without interference from the blocking end of the second blocking member, but when the second blocking member is permitted to pivot radially outwardly with its blocking end fully through the sensing slot, this blocking end will generally axially interfere with the pivotal holder portion adjacent the sensing slot and prevent the pivotal holder portion from such pivoting maintaining it close to its axial alignment with its associated stationary holder portion 40.

Figure 11:
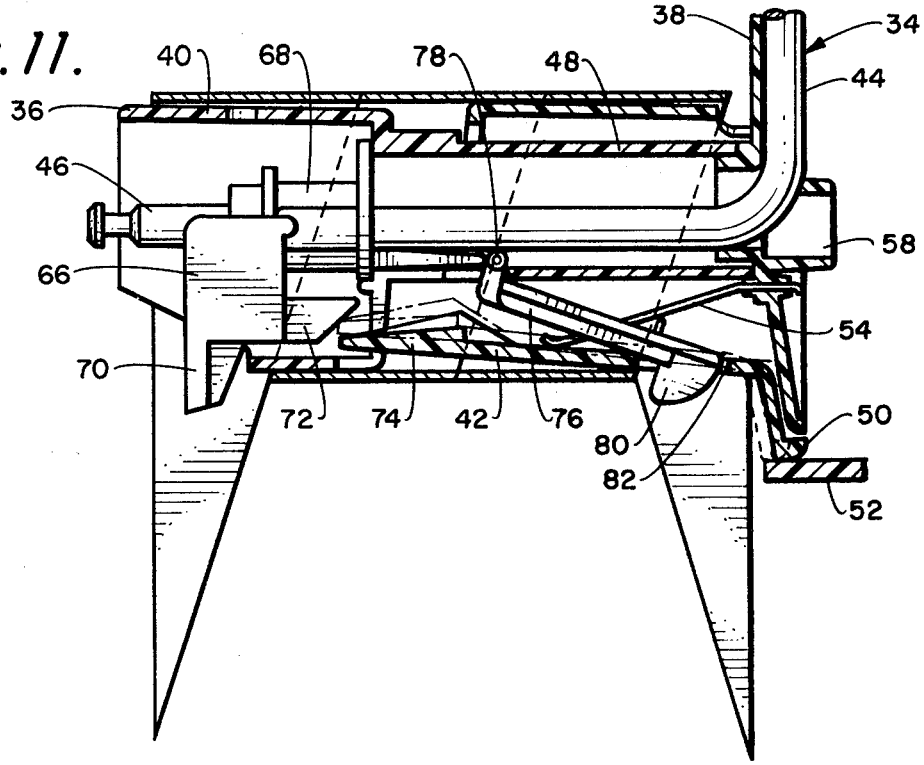
FIG. 11 is a view similar to FIG. 6, but only including essentially the lower roll holder of the dual roll holder assembly, the lower roll holder still being in its same position retained by the dispenser as in FIG. 6 with attempted core stripping having caused actuation of the blocking means blocking the lower roll holder in such position.

Thus, a first blocking member 66 is provided for sensing that part of the split core 64 on the stationary holder portion 40 of that particular roll holder 36 and a second blocking member 76 is provided for similarly sensing that part of the split core on the pivotal holder portion 42, and if either split core part is removed, or parts of a solid core similarly being sensed are removed, either or both of the first and second blocking members will automatically move to their blocking positions blocking the particular pivotal holder portion 42 and preventing the same from pivoting to release the dual roll holder assembly 34. As shown in FIG. 6 and referring to the lower roll holder 36, the sensing dog 70 of the first blocking member 66 is sensing the split core 64 and the blocking end 80 of the second blocking member is sensing the split core so that when the tissue of the particular roll of tissue 62 is depleted with the split core parts remaining and separable at the correct axial location as shown in FIG. 10, the first and second blocking members will be ineffective to interfere with the pivotal movement of the pivotal holder portion 42 permitting release of the dual roll holder assembly 34 for automatic operation in the usual manner of the dispenser 20 as hereinbefore described. When, however, the core of the particular roll of tissue is removed so as to be no longer sensed by either or both of these first and second blocking members 66 and 76 as shown in FIG. 11, either or both of the blocking members will automatically pivot to their blocking positions interferring with the particular pivotal holder portion 42 and preventing the same from pivoting to release the dual roll holder assembly 34. This means that unless rolls of tissue 62 having substantially the correct split cores 64 therein which remain on the roll holders 36 and properly permit the correct operation of the dispenser 20 are used, the dispenser will not correctly operate, thereby frustrating improper tissue roll core use and tending to eliminate the previously discussed littering problem.

Figure 12:
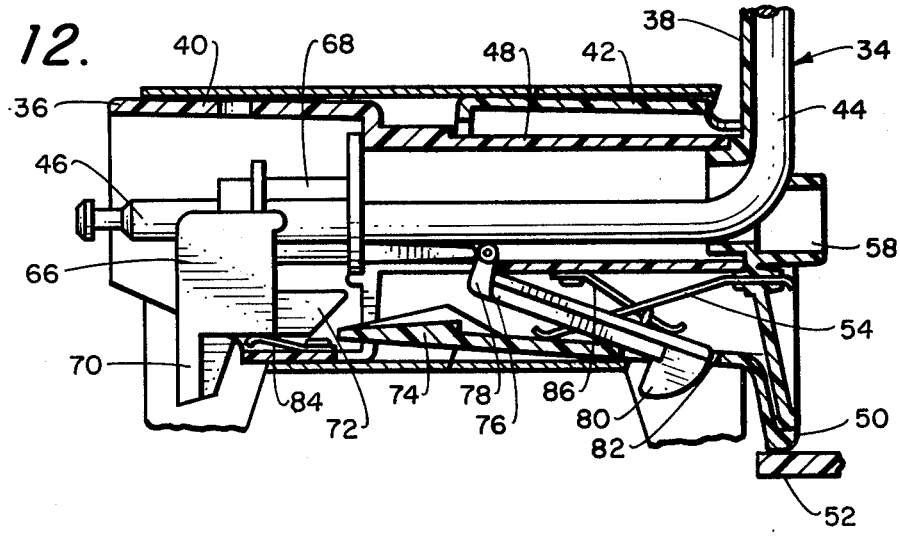
FIG. 12 is a view similar to FIG. 6, but only including essentially the lower roll holder of the dual roll holder assembly and with the lower roll holder having added structure to illustrate a second embodiment of the roll holder improvements of the present invention.

In addition to the foregoing, the first and second blocking members 66 and 76 for the roll holders 36 tend to provide a supplementary advantage by tending to minimize the well-known tissue roll "milking" otherwise caused by pulling on the length of tissue being dispensed from a particular roll to cause the roll to rapidly rotate and waste a quantity of such tissue. As shown, for instance, in FIG. 6, during sensing, the first and second blocking members 66 and 76 both contact the core of the particular roll of tissue being dispensed so as to frictionally, at least moderately, resist the free rotation of the core on the particular roll holder 36. This frictional engagement by the first and second blocking members 66 and 76 and a more positive automatic pivotal operation thereof may be obtained by adding appropriate leaf springs 84 and 86 to resiliently bear against the respective first and second blocking members tending to urge them toward their blocking positions as shown in the second embodiment of FIG. 12. The over-spinning or "milking" of the rolls of tissue 62 will be even more positively frictionally frustrated while the first and second blocking members 66 and 76 will still sense and block in precisely the same manner as previously described.

According to the principles of the present invention, therefore, one or more unique blocking members are provided, such as the first and second blocking members 66 and 76, for a split-core type of roll holder in a dispenser which prevent operation and movement of the roll holder when improper rolls of tissue having improper split cores or solid cores are used so as to frustrate attempts at releasing the roll holder to cause it to move by stripping the improper cores therefrom, thereby tending to eliminate a stripped core littering problem which is damaging to our ecology. Furthermore, the core stripping blocking concept of the present invention is quite conveniently adaptable to dual tissue roll dispensers making use of dual roll holder assemblies, such as the dispenser 20 and the dual roll holder assembly 34. As in the prior constructions, the dual roll holder assembly is automatically movable in the same manner as before and is selectively reversible as before so as to obtain all of the previous advantages, yet the same blocking concept is also provided operable despite the reversibility of the dual roll holder assembly so as to obtain all of the advantages of the present invention.

I claim:

1. A roll holder of the type for mounting split-core rolls of tissue and the like in a dispenser, the roll holder retaining a roll in a dispensing position until the tissue thereof is exhausted to automatically uncover axially separable roll core parts while still retaining the same thereon, the roll core parts through limited displacement one relative to the other as urged by the roll holder automatically releasing roll holder latch means permitting the roll holder with the retained core parts to move radially to an exhausted position; the improvements including: blocking means operably associated with the roll holder latch means normally retained in a non-active position through engagement by a portion of certain of said roll core parts permitting said automatic release of said roll holder latch means during roll tissue exhaustion and automatically movable to an active position preventing said automatic release of said roll holder latch means upon a lacking of said certain core part engagement.

2. A roll holder as defined in claim 1 in which said blocking means includes a blocking member for each core part, each blocking member being normally retained in a non-active position through engagement by a portion of its respective roll core part and being automatically movable to an active position preventing said automatic release of said roll holder latch means upon a lacking of its core part engagement.

3. A roll holder as defined in claim 1 in which said blocking means includes a blocking member at each end of said roll holder each normally retained in a non-active position through engagement by a portion of certain of said roll core parts and automatically movable to an active position preventing said automatic release of said roll holder latch means upon lacking of said certain core part engagement.

4. A roll holder as defined in claim 1 in which said blocking means includes a blocking member at each end of said roll holder, each blocking member normally being telescoped by a separate core part and retained in a non-active position through engagement by its respective core part, each blocking member being automatically movable to an active position preventing said automatic release of said roll holder latch means upon a lacking of its respective core part engagement.

5. A roll holder as defined in claim 1 in which said roll holder is of the type wherein one axial part of said roll holder radially pivots relative to another axial part thereof to release said roll holder latch means, said roll core parts being separable axially between said roll holder axial parts; and in which said blocking means in its active position engages said roll holder one axial part preventing it from pivoting and releasing said roll holder latch means.

6. A roll holder as defined in claim 1 in which said roll holder is of the type wherein one axial part of said roll holder radially pivots relative to another axial part thereof to release said roll holder latch means, said roll core parts being separable axially between said roll holder axial parts; and in which said blocking means includes a blocking member for each core part, each blocking member being normally retained in a non-active position through engagement by a portion of its respective roll core part, each blocking member being automatically movable to an active position engaging said roll holder one axial part preventing it from pivoting and releasing said roll holder latch means upon a lacking of its core part engagement.

7. A roll holder as defined in claim 1 in which said roll holder is of the type wherein one axial part of said roll holder radially pivots relative to another axial part thereof to release said roll holder latch means, said roll core parts being separable axially between said roll holder axial parts; and in which said blocking means includes a blocking member at each end of said roll holder each normally retained in a non-active position through engagement by a different one of said roll core parts, each blocking member being automatically movable to an active position engaging said roll holder one axial part preventing it from pivoting and releasing said roll holder latch means upon lacking of its respective roll core part engagement.

8. A roll holder as defined in claim 1 in which said roll holder is of the type wherein one axial part of said roll holder radially pivots relative to another axial part thereof to release said roll holder latch means, said roll core parts being separable axially between said roll holder axial parts; and in which said blocking means includes a blocking member at each end of said roll holder, each blocking member normally being telescoped by a separate of said core parts and being retained in a non-active position through engagement by its respective core part, each blocking member being automatically movable to an active position engaging said roll holder one axial part preventing it from pivoting and releasing said roll holder latch means upon a lacking of its respective core part engagement.

9. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains the lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder.

10. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains that lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder; and in which said blocking means of each roll holder includes a blocking member for each core part, each blocking member being normally retained in a non-active position through engagement by a portion of its respective roll core part and being automatically movable to an active position preventing said automatic release of said roll holder latch means upon a lacking of its core part engagement.

11. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains that lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder; and in which said blocking means of each roll holder includes a blocking member at each end of said roll holder each normally retained in a non-active position through engagement by a portion of certain of said roll core parts and automatically movable to an active position preventing said automatic release of said roll holder latch means upon lacking of said certain core part engagement.

12. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains that lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder; in which each of said roll holders is of the type wherein one axial part of said roll holder radially pivots relative to another axial part thereof to release said roll holder latch means, said roll core parts being separable axially between said roll holder axial parts; and in which said blocking means of each of said roll holders in its active position engages said roll holder one axial part preventing it from pivoting and releasing said roll holder latch means.

13. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains that lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder; in which each of said roll holders is of the type wherein one axial part of said roll holder radially pivots relative to another axial part thereof to release said roll holder latch means, said roll core parts being separable axially between said roll holder axial parts; and in which said blocking means of each of said roll holders includes a blocking member for each core part, each blocking member being normally retained in a non-active position through engagement by a portion of its respective roll core part and being automatically movable to an active position engaging its roll holder one axial part preventing it from pivoting and releasing its roll holder latch means upon a lacking of its core part engagement.

14. A roll holder as defined in claim 1 in which said roll holder is one of an assembly of two radially spaced and aligned roll holders, said roll holder assembly being of the type selectively reversely mountable in a dispenser with either roll holder being a lower roll holder while the other roll holder is an upper roll holder, each of said roll holders being substantially identical so that when said roll holder assembly is positioned with either roll holder as the lower roll holder the latch means thereof retains that lower roll holder in a dispensing position with the then upper roll holder in a reserve position and release of said latch means of that lower roll holder permits the assembly to move downwardly placing that lower roll holder in an exhausted position and the then upper roll holder in a dispensing position, said blocking means of either of said roll holders being effectively actionable when said assembly is positioned with that roll holder as the lower roll holder; in which each of said roll holders is of the type wherein one axial part of said roll holder radially pivots relative to another axial part thereof to release said roll holder latch means, said roll core parts being separable axially between said roll holder axial parts; and in which said blocking means of each roll holder includes a blocking member at each end of its roll holder, each blocking member normally being telescoped by a separate core part and retained in a non-active position through engagement by its respective core part, each blocking member being automatically movable to an active position engaging its roll holder one axial part preventing said automatic release of its roll holder latch means upon a lacking of its respective core part engagement.

* * * * *